US006224039B1

(12) United States Patent
Okamoto et al.

(10) Patent No.: US 6,224,039 B1
(45) Date of Patent: May 1, 2001

(54) CHAIN BLOCK

(75) Inventors: Yosiaki Okamoto; Takasi Uesugi, both of Osaka (JP)

(73) Assignee: Elephant Chain Block Co., Ltd. (JP)

( * ) Notice: Subject to any disclaimer, the term of this patent is extended or adjusted under 35 U.S.C. 154(b) by 0 days.

(21) Appl. No.: 09/420,243

(22) Filed: Oct. 19, 1999

(30) Foreign Application Priority Data

Oct. 23, 1998 (JP) ..... 10-301896

(51) Int. Cl.[7] ..... B66D 1/14
(52) U.S. Cl. ..... 254/346; 254/352; 254/372
(58) Field of Search ..... 254/352, 353, 254/346, 365, 369, 376, 372

(56) References Cited

U.S. PATENT DOCUMENTS

| | | | |
|---|---|---|---|
| 5,305,989 | 4/1994 | Nishi et al. | 254/352 |
| 5,351,937 | 10/1994 | Nishi et al. | 254/352 |
| 5,472,171 * | 12/1995 | Nishi et al. | 254/352 |

FOREIGN PATENT DOCUMENTS

| | | |
|---|---|---|
| 39-8908 | 4/1964 | (JP) . |
| 55-14197 | 7/1978 | (JP) . |
| 7-12912 | 2/1995 | (JP) . |
| 7-8557 | 3/1995 | (JP) . |
| 7-157290 | 6/1995 | (JP) . |

* cited by examiner

*Primary Examiner*—Katherine A. Matecki
(74) *Attorney, Agent, or Firm*—George T. Marcou; Kilpatrick Stockton LLP

(57) ABSTRACT

A chain block which can ensure free rotation of a hand wheel when the hand wheel is rotated in a hoisting direction in the state in which an overload protection mechanism is in operation and also can ensure the lowering of a load when the hand wheel is rotated in a lowering direction. The chain block includes an one-way mechanism that permits the hand wheel to freely rotate in the hoisting direction with respect to the first hub of the hand wheel and restricts the hand wheel freely rotating in the lowering direction. The one-way mechanism is composed of a spring and a pin received in a recess and a receiving portion formed in the inner periphery of the boss of the hand wheel and forming therein a slanted surface for guiding the pin received in the receiving portion to the inner periphery of the boss when the hand wheel is rotated in the hoisting direction and a retaining surface for retaining the pin in the inside of the receiving portion when the hand wheel is rotated in the lowering direction.

2 Claims, 6 Drawing Sheets

CHAIN BLOCK

BACKGROUND OF THE INVENTION

1. Field of the Invention

The present invention relates to a chain block and, more particularly, to a hand operated chain block wherein a load sheave is rotated to wind up and down a load chain passing over the load sheave by the operation of a hand chain passing over a hand wheel.

2. Description of the Prior Art

In general, hand operated chain blocks of this type comprise a load sheave supported between two opposed side plates via bearings; a hand wheel disposed at the outside of one side plate to drive the load sheave through a drive shaft and a reduction gear mechanism; and a transmission mechanism having a mechanical brake which is interposed between the hand wheel and the load sheave to apply a given brake and are so structured that a load suspended from a hook of the load chain passing over the load sheave can be hoisted up and lowered down by the operation of a hand chain passing over the hand wheel.

Of these known chain blocks, some are provided with an overload protection mechanism that permits the hand wheel to freely rotate in the hoisting direction when a load in excess of a rated load of the chain block is applied to the load sheave, for preventing the hoist of the load more than the rated load.

The overload protection mechanism comprises, for example, a hub member threadedly mounted on the drive shaft and supporting thereon the hand wheel in a freely rotatable manner; a load setting mechanism, arranged at an axially outside end portion of the hub member, for setting a rated load; and two lining plates interposed in a freely rotatable manner between the hub member and the hand wheel and between the hand wheel and the load setting mechanism, respectively. The overload protection mechanism is so structured that when the hand wheel is rotated in the hoisting direction in the state in which a load more than a rated load as is preset by the load setting mechanism pressing the lining plates is being applied, slippage of the hand wheel can be caused between the two lining plates placed at both sides of the hand wheel to permit free rotation of the hand wheel with respect to the hub member.

On the other hand, for example when the overload protection mechanism is put into action in the hoist of the load by the application of a load more than the rated load, the hand wheel is held slipped between the two lining plates placed at both sides thereof, and as such cannot permit the lowering of the load. For permitting the lowering of the load in such a situation, the hub member is provided, in an outer periphery thereof, with a recessed portion in which a pin and a biasing spring for biasing the pin radially outwardly are housed and also a boss of the hand wheel is provided, in an inner periphery thereof, with a receiving portion that can permit the pin to be retained therein only when the hand wheel is rotated in the lowering direction, whereby an one-way mechanism that permits free rotation of the hand wheel with respect to the hub member only in the hoisting direction and restricts the free rotation of the hand wheel in the lowering direction is formed so that the lowering of the load can be permitted even when a load more than the rated load is applied.

With this arrangement, when the hand wheel is rotated in the lowering direction in the state in which it is being slipped between the two lining plates placed at the both sides of the hand wheel by the action of the overload protection mechanism, the pin is smoothly received in the receiving portion but is sometimes caught in the receiving portion even when the hand wheel is rotated in the hoisting direction, depending on the form of the receiving portion. As a result of this, despite the load being more than the rated load, the load is sometimes hoisted in an unstable state, or the pin and the receiving portion are sometimes damaged. Also, there is presented a disadvantage that the hand wheel, when rotated, may rattle to cause damage to the hub member and the hand wheel. In the hand operated chain block of this type, in particular, even a little pulling of the hand chain may cause the hand wheel to rotate a couple of turns, and as such will give increased opportunities of the pin and the receiving portion to confront each other, thus significantly expanding the influence of the disadvantages above. Further, when it comes to a small-sized chain block having the hand wheel of a small diameter, even the little pulling of the hand chain will give further increased opportunities of the pin and the receiving portion to confront each other, thus further significantly expanding the influence.

SUMMARY OF THE INVENTION

To solve the problems mentioned above, the present invention has been made. It is the object of the present invention is to provide a chain block that can ensure free rotation of a hand wheel when the hand wheel is rotated in a hoisting direction in the state in which an overload protection mechanism is in operation and also can ensure the lowering of a load when the hand wheel is rotated in a lowering direction.

The present invention provides a novel chain block comprising a load sheave with which a load chain is engageable; a hand wheel with which a hand chain is engageable; a transmission mechanism including a mechanical brake interposed between the hand wheel and the load sheave; an overload protection mechanism that supports the hand wheel and permits the hand wheel to freely rotate in a hoisting direction when a load more than a rated load is applied to the load sheave; and a drive shaft, passed through the load sheave, the transmission mechanism and the overload protection mechanism, to transmit drive applied from the hand wheel to the load sheave, wherein the overload protection mechanism includes a hub member threadedly engaged with the drive shaft and supporting thereon the hand wheel in a freely rotatable manner; and an one-way mechanism that permits the hand wheel to freely rotate in a hoisting direction with respect to the hub member and restricts the hand wheel freely rotating in a lowering direction; wherein the one-way mechanism includes a recess formed in an outer periphery of the hub member; an engaging member provided in the recess and normally biased radially outwardly; and a concave receiving portion, opening in an inner periphery of a boss of the hand wheel, to receive the engaging member therein; and wherein the receiving portion includes a slanted surface extended obliquely to guide the engaging member received in the receiving portion to the inner periphery of the boss of the hand wheel when the hand wheel is rotated in the hoisting direction; and a retaining surface, extended substantially along a radial direction of the inner periphery of the boss, to permit the engaging member received in the receiving portion to be retained in an inside of the receiving portion when the hand wheel is rotated in a lowering direction.

With this arrangement, when a load more than a rated load applied to the load sheave is tried to be hoisted by rotating the hand wheel in the hoisting direction, the hand wheel is permitted to freely rotate with respect to the hub member threadedly engaged with the drive shaft. Thus, the hoist of any load more than the rated load of the chain block is prevented. During the free rotation of the hand wheel with respect to the hub member, every time the engaging member of the one-way mechanism faces the receiving portions formed in the inner periphery of the boss of the hand wheel, the engaging member which is normally biased radially outwardly or toward the inner periphery of the boss of the hand wheel is received in the receiving portions, while on the other hand, the as-received engaging member is smoothly guided again to the inner periphery of the boss of the hand wheel along the slanted surface formed in each of the receiving portions.

This can produce the results that a possible problem that the engaging member may be caught in the receiving portion so that a load more than a rated load may be hoisted in an unstable state or a possible damage of the engaging member and the receiving portion can be minimized. Also, the rattling of the hand wheel that may be caused when rotated can be minimized and a possible damage to the hub member and the hand wheel can be minimized.

On the other hand, for example, when the overload protection mechanism is put into action in the hoist of a load by the application of load more than a rated load, the hand wheel can be restricted freely rotating in the lowering direction with respect to the hub member by the engaging member of the one-way mechanism being received in the receiving portion. This can permit the lowering of even a load more than the rated load. At that time, the engaging member received in the receiving portion is well retained by the retaining surface formed in the receiving portion.

This arrangement that enables the engaging member received in the receiving portion to be well retained by the retaining surface formed in the receiving portion when the hand wheel is rotated in the lowering direction can provide the result that the free rotation of the hand wheel with respect to the hub member can reliably be restricted and thereby the lowering of even a load more than a rated load can be ensured.

According to this invention, it is preferable that the slanted surface formed in the receiving portion is extended along a tangential direction to the inner periphery of the hand wheel and also is smoothed out at a boundary between the inner periphery of the boss of the hand wheel and the slanted surface.

With this arrangement, when the hand wheel is rotated in the hoisting direction in the situation in which the hand wheel is put in the state of being freely rotatable with respect to the hub member by application of a load more than a rated load to the load sheave, every time the engaging member received in the receiving portion faces the receiving portion, the engaging member is smoothly guided again to the inner periphery of the boss of the hand wheel along the tangential direction to the inner periphery of the hand wheel and along the slanted surface smoothed out at the boundary between the slanted surface and the inner periphery of the boss of the hand wheel. On the other hand, when the hand wheel is rotated in the lowering direction, the engaging member is smoothly received into the receiving portion along the tangential direction to the inner periphery of the hand wheel and along the slanted surface smoothed out at the boundary between the slanted surface and the inner periphery of the boss of the hand wheel.

In this arrangement, since the slanted surface of the receiving portion is so formed as to extend along the tangential direction to the inner periphery of the hand wheel and is smoothed out at the boundary between the slanted surface and the inner periphery of the boss of the hand wheel, when the hand wheel is rotated in the hoisting direction in the situation in which the hand wheel is put in the state of being freely rotatable with respect to the hub member by application of a load more than a rated load to the load sheave, the engaging member received in the receiving portion can be guided smoothly to the inner periphery of the boss of the hand wheel just the way it is, without causing the engaging member received in the receiving portions to rattle. Also, when the hand wheel is rotated in the lowering direction, the engaging member can be received into the receiving portion smoothly without causing the engaging member to rattle.

Thus, for example in a hand operated chain block in which even a little pulling of the hand chain in the hoisting direction causes the hand wheel to rotate with respect to the hub member a couple of turns during which the engaging member confronts the receiving portions several times, when the hand wheel is rotated in the hoisting direction in the situation in which the hand wheel is put in the state of being freely rotatable with respect to the hub member by application of a load more than a rated load to the load sheave, smooth free rotation of the hand wheel with respect to the hub member can be ensured, while also, when the hand wheel is rotated in the lowering direction, the engaging member can smoothly be received in the receiving portion to ensure the smooth lowering of load.

According to this invention, it is preferable that there are provided receiving portions which are opened in the inner periphery of the hand wheel at positions opposed to each other and of which slanted surfaces are formed to be substantially parallel to each other.

With this arrangement, when the hand wheel is rotated in the hoisting direction in the situation in which the hand wheel is put in the state of being freely rotatable with respect to the hub member by application of a load more than a rated load to the load sheave, the engaging member is received in each of the receiving portions provided at the opposed positions every time the hand wheel is rotated one turn. Even when the engaging member is received in any of the receiving portions, since the slanted surfaces in the receiving portions are so formed as to be substantially parallel to each other, the engaging member received is guided to the inner periphery of the boss of the hand wheel along the slanted surface under the same condition. On the other hand, when the hand wheel is rotated in the lowering direction, the engaging member is received in any of the receiving portions provided at the opposed positions during one-turn of the hand wheel.

This can provide the result that in the chain block in which even a little pulling of the hand chain causes the hand wheel to rotate a couple of turns, so as to give several opportunities of the engaging member to confront the receiving portions, since the receiving portions are provided at the opposed positions and also the slanted surfaces are so formed as to be substantially parallel with each other, even when the engaging member is given many opportunities to confront the receiving portions, the engaging member is received cliclically in the receiving portions as the hand wheel rotates and is guided to the inner periphery of the boss of the hand wheel along the slanted surfaces under the same condition. Thus, regular operations can be ensured. On the other hand, when the hand wheel is rotated in the lowering direction, since the engaging member is received in any of the receiving portions during one-turn of the hand wheel, the engaging member is brought into engagement in the receiving potion to permit the lowering of load until the hand wheel rotates one turn.

Thus, for example, in a small-sized chain block having the hand wheel having a small diameter in which even a little pulling of the hand chain causes the engaging member to confront the receiving portions many times, good operation of the engaging member and the receiving portions can be ensured and, thus, improved durability and reliability of the one-way mechanism can be provided.

BRIEF DESCRIPTION OF THE DRAWINGS

The present invention will now be described with reference to the accompanying drawings wherein.

DETAILED DESCRIPTION OF THE PREFERRED EMBODIMENTS

Referring now to the accompanying drawing figures, an example of the preferred embodiment of the invention is described below.

Figure 1:
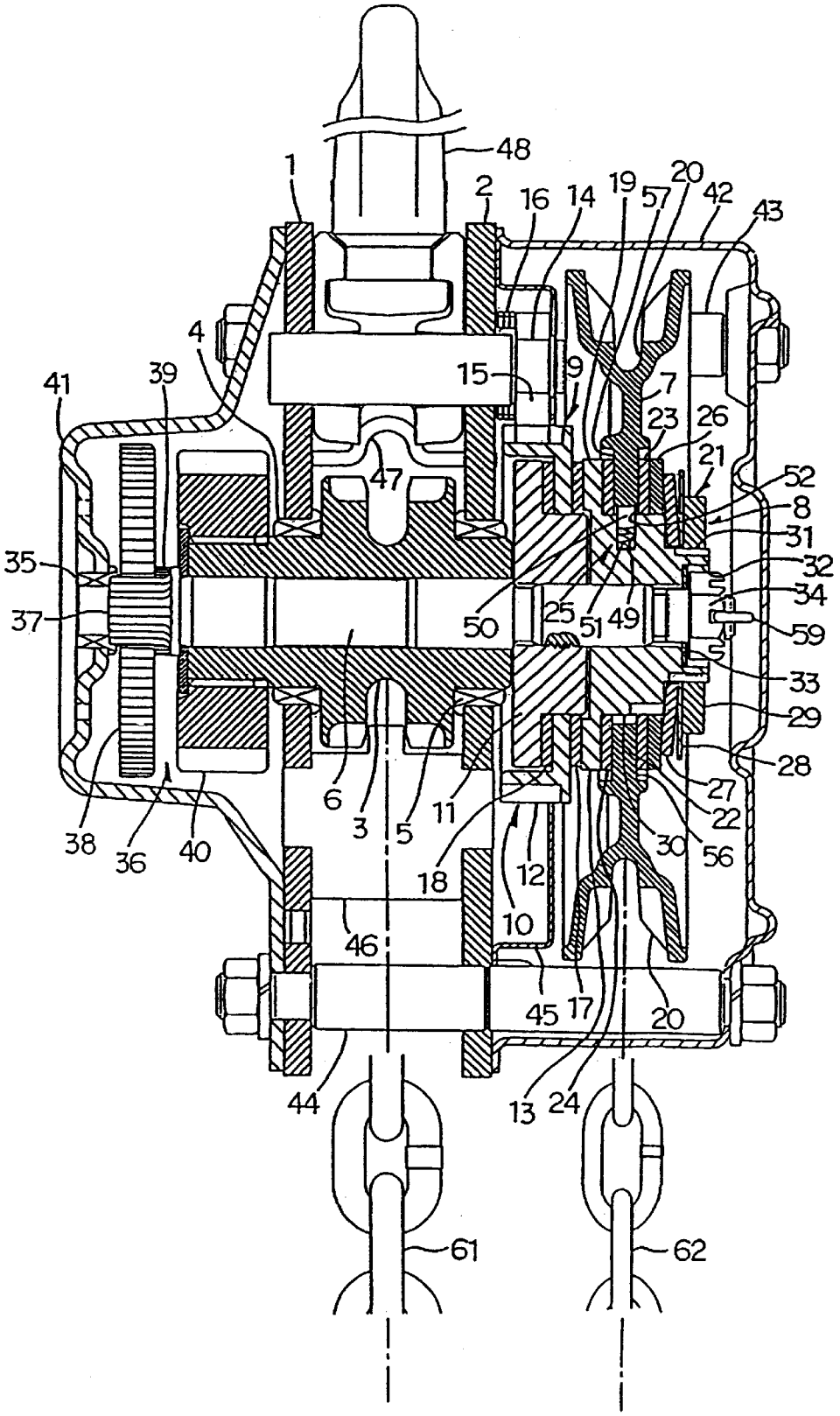
FIG. 1 illustrates in longitudinal section a small-sized hand operated chain block as one embodied form of a chain block of the present invention.

Referring to FIG. 1, there is shown a longitudinal section of a small-sized hand operated chain block of one embodiment of the present invention. In the chain block, a load sheave 3 over which a load chain 61 passes in engaging relation is rotatably supported between opposed left and right side plates 1, 2 via two bearings 4, 5.

A drive shaft 6 is inserted in a shaft hole of the load sheave 3 in freely rotatable relation, and a transmission mechanism 10 having a mechanical brake 9 and an overload protection mechanism 8 are supported by the drive shaft 6 at the outside of the right side plate 2 in an inserted state. A hand wheel 7 over which a hand chain 62 passes in an engaging relation is supported in the overload protection mechanism 8. As will be mentioned later, the drive shaft 6 is substantially the same as a drive shaft used in a chain block which is not equipped with the overload protection mechanism 8.

The transmission mechanism 10 includes a second hub 11 connected to the drive shaft 6 in a non-rotatable relation (in a threaded connection in FIG. 1); a third lining plate 17, an anti-reverse gear 12; and a fourth lining plate 18.

The second hub 11 is formed in one piece having a flange portion and a cylindrical portion extending axially therefrom. The anti-reverse gear 12, the third lining plate 17 and the fourth lining plate 18 are rotatably supported on the cylindrical portion of the second hub 11 in such a manner that the third lining plate 17 is interposed between the anti-reverse gear 12 and a first hub 13 of the overload protection mechanism 8 mentioned later and the fourth lining plate 18 is interposed between the flange portion of the second hub 11 and the anti-reverse gear 12.

Figure 2:
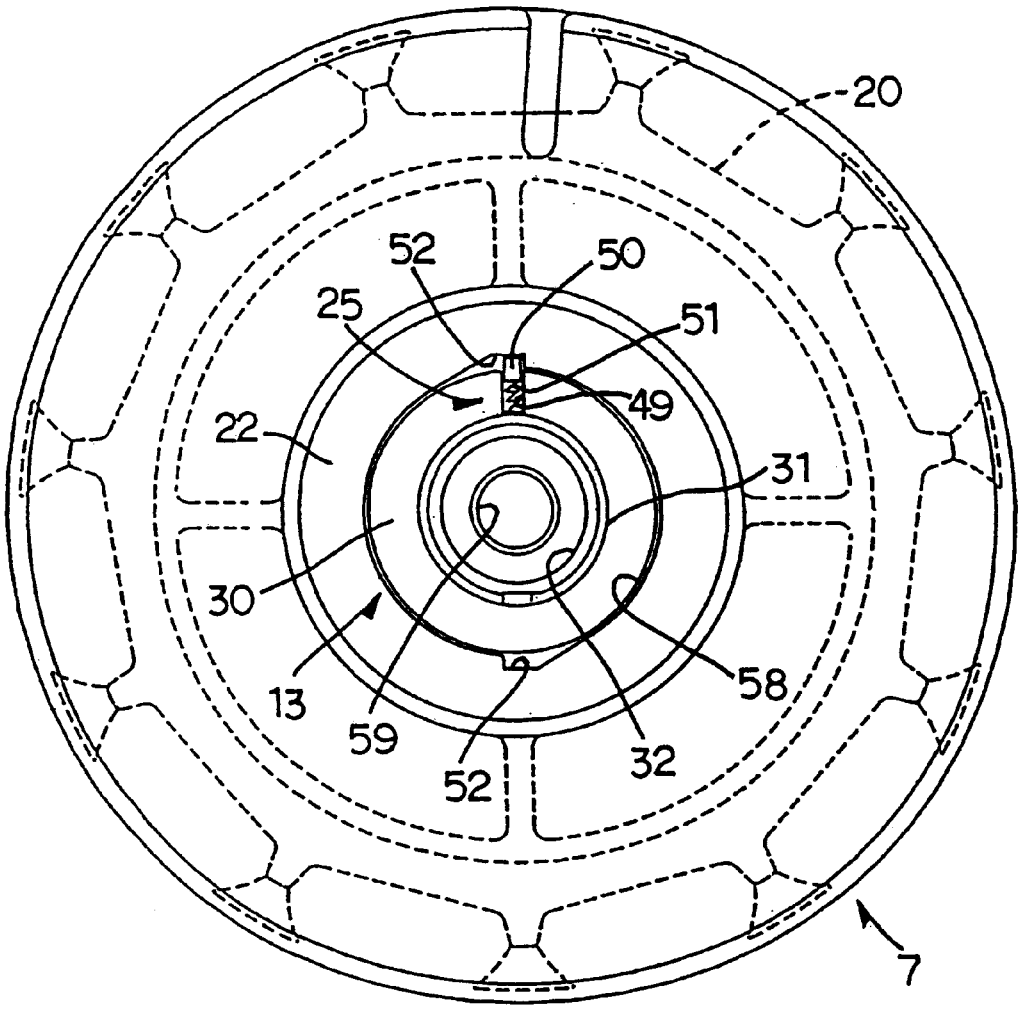
FIG. 2 is a side view of a hand wheel of the chain block shown in FIG. 1.
Figure 3:
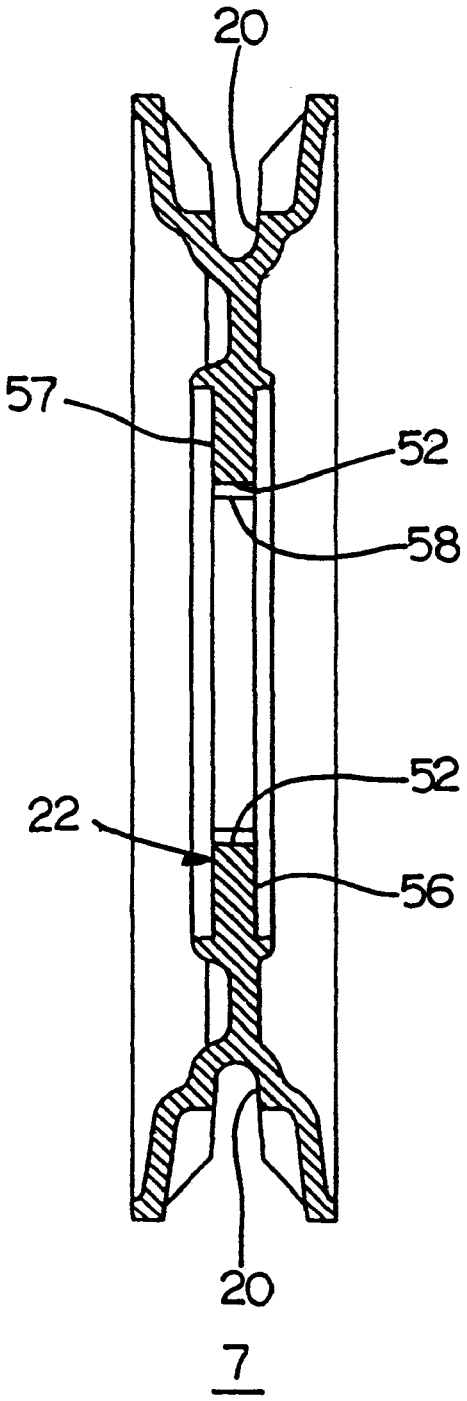
FIG. 3 is a front view of the hand wheel shown in FIG. 2.

A pawl shaft 14 is provided on the right side plate 2 and an anti-reverse pawl 15 engageable with the anti-reverse gear 12 is swingably pivoted on the pawl shaft 14. Further, a pawl spring 16 for biasing the anti-reverse pawl 15 toward the anti-reverse gear 12 is provided between the anti-reverse pawl 15 and the right side plate 2. The mechanical brake 9 of the transmission mechanism 10 is composed of the second hub 11, the anti-reverse gear 12, the anti-reverse pawl 15, the third lining plate 17 and the fourth lining plate The hand wheel 7 has on the outer periphery side thereof a plurality of pockets 20 for receiving therein chain links of a hand chain 62 and also has on the base side thereof a boss 22 in which a receiving hole 58 for receiving therein the first hub 13 of the overload protection mechanism 8 mentioned later is formed, as shown in FIGS. 2 and 3. Formed at both sides of the boss 22 are a second recess 56 and a third recess 57 formed in the recessed form for receiving therein a first lining plate 23 and a second lining plate 24 mentioned later, respectively. The second recess 56 and the third recess 57 are formed in circular, in side configuration, of slightly larger in diameter than the outer diameters of the first lining plate 23 and the second lining plate 24 and formed with a depth substantially equal to a thickness of the first lining plate 23 and the second lining plate 24.

The overload protection mechanism 8 includes the first hub 13 of a hub member threadedly engaged with the drive shaft 6, the load setting mechanism 21 for setting a rated load, the first lining plate 23 acting as a brake disc, the second lining plate 24 acting as the brake disc and one-way mechanism 25 that permits free rotation of the hand wheel 7 in the hoisting direction with respect to the first hub 13 and restricts the free rotation of same in the lowering direction, as shown in FIG. 1.

Figure 4:
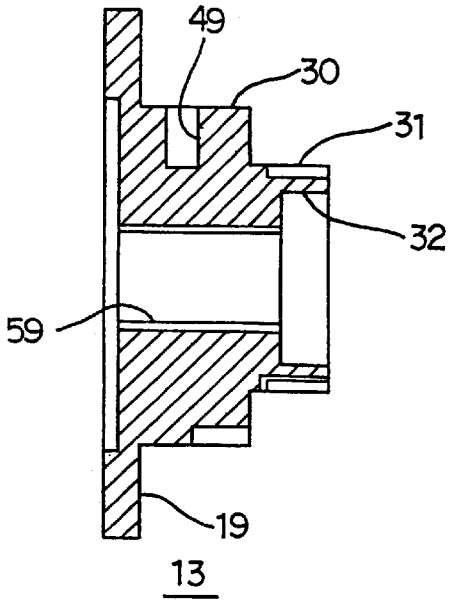
FIG. 4 is a side view of a first hub of the chain block shown in FIG. 1.
Figure 5:
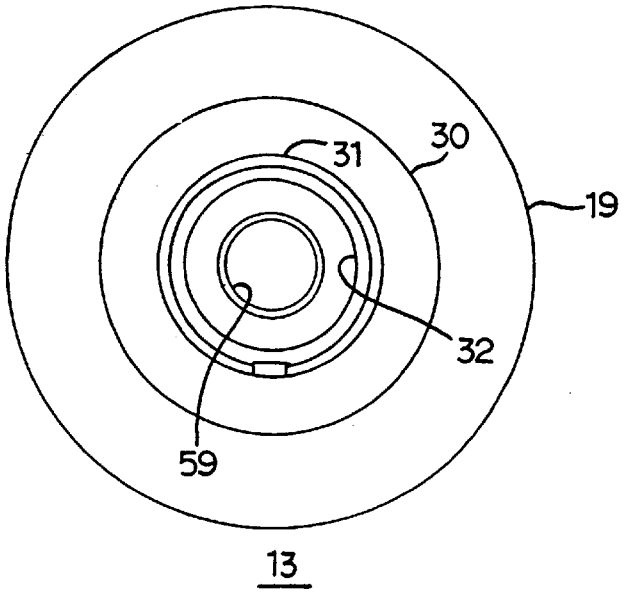
FIG. 5 is a front view of the first hub shown in FIG. 2.

The first hub 13 is formed in one piece having a flange portion 19, a large-diameter cylindrical portion 30 extending axially outwardly from the flange portion 19 and a small-diameter cylindrical portion 31 extending axially outwardly from the large-diameter cylindrical portion 30 and being smaller in diameter than the large-diameter cylindrical portion 30, as shown in FIGS. 4 and 5. The small-diameter cylindrical portion 31 has on an end surface thereof a first recess 32 opening in the form of a recessed portion. The first recess 32 is formed in circular, in side configuration, of not less in diameter than a set nut 34 mentioned later and formed with such a depth as to receive at least a part of the set nut 34. The small-diameter cylindrical portion 31 is externally threaded.

The hand wheel 7, the first lining plate 23 and the second lining plate 24 are rotatably supported on the large-diameter cylindrical portion 30 of the first hub 13 in such a manner that the first lining plate 23 is interposed between the boss 22 of the hand wheel 7 and a lining keep member 26 of the load setting mechanism 21 mentioned later and the second lining plate 24 is interposed between the flange portion 19 of the first hub 13 and the boss 22 of the hand wheel 7. As a result of this, the first lining plate 23 and the second lining plate 24 are fitted in the second recess 56 and the third recess 57 formed at the both sides of the boss 22 of the hand wheel 7, respectively.

The load setting mechanism 21 is composed of the lining keep member 26, a belleville spring 27 serving as a biasing means, a locking member 28 and a tightening nut 29. With contacting with the first lining plate 23, the lining keep member 26 is rotatably supported on the large-diameter cylindrical portion 30 of the first hub 13, as aforesaid. For biasing the lining keep member 26 toward the first lining plate 23, the belleville spring 27 is supported on the small-diameter cylindrical portion 31 of the first hub 13, with contacting with the lining keep member 26. For adjusting the biasing force of the belleville spring 27, the tightening nut 29 is threadedly engaged with the small-diameter cylindrical portion 31 of the first hub 13, with pressing the belleville spring 27 through the locking member 28.

Thus, when the tightening nut 29 is screwed forward along the small-diameter cylindrical portion 31 of the first hub 13, the first lining plate 23, the hand wheel 7 and the second lining plate 24 existing between the tightening nut 29 and the flange portion 19 of the first hub 13 are pressed through the lining keep member 26 by the belleville spring 27 so strongly that even when a heavy load is hoisted, the hand wheel 7 can be prevented from slipping over the first lining plate 23 and the second lining plate 24, thus permitting the setting of an increased rated load. On the other hand, as the tightening nut 29 is screwed backward along the small-diameter cylindrical portion 31 of the first hub 13, the pressing force of the belleville spring 27 to the first lining plate 23, the hand wheel 7 and the second lining plate 24 between the tightening nut 29 and the flange portion 19 of the first hub 13 decreases, so that when a heavy load is hoisted, the hand wheel 7 can be slipped over the first lining plate 23 and the second lining plate 24, thus permitting the setting of an decreased rated load.

The set nut 34 used as a restricting member is threadedly engaged with an end portion of the drive shaft 6 on which the overload protection mechanism 8 is mounted, with spaced at a predetermined interval from the first hub 13 threadedly mounted on the drive shaft 6. In the first recess 32 opening in the end surface of the small-diameter cylindrical portion 31 of the first hub 13, the set nut 34 is fixed to the end portion of the drive shaft 6 by a set pin 59 so that it cannot be moved in the axial direction. The axial movement range of the first hub 13 is restricted by the set nut 34, with a washer 33 interposed between the set nut 34 and a bottom of the first recess 32.

On the other hand, the drive shaft 6 is supported by the bearing 35 at the other axial end portion thereof, and the reduction gear mechanism 36 having a plurality of reduction gears is provided between the bearing 35 and the load sheave 3 and at the outside of the left side plate 1. The reduction gear mechanism 36 is composed of the first gear 37 integrally formed on the axial end portion of the drive shaft 6, the second gear 38 and the third gear 39 supported on a pair of intermediate shafts and engageable with the first gear 37 (which are not shown and only one of the second gear 38 and the third gear 39 is shown in FIG. 1) and the fourth gear 40 connected with an extended portion of the load sheave 3 and engageable with the third gear 39. The drive from the drive shaft 6 is transmitted from the first gear 37 to the second gear 38 engaged with the first gear and then transmitted to the fourth gear 40 from the intermediate shaft supporting the second gear 38 thereon through the third gear 39 supported on the same intermediate shaft. Thus, the drive from the drive shaft 6 is transmitted to the load sheave 3 at a predetermined reduction ratio.

A gear cover 41 for covering the reduction gear mechanism 36 and a wheel cover 42, opening at one side thereof, for covering the hand wheel 7 are detachably mounted on the left side plate 1 at the outside thereof and the right side plate 2 at the outside thereof, respectively, with three stay bolts connecting between the left side plate 1 and the right side plate 2 (only two stay bolts 43, 44 are shown in FIG. 1). Provided between the right side plate 2 and the hand wheel 7 is a brake cover 45 for covering a circumferential portion of the anti-reverse gear 12. Further, a chain split 46 is provided between the left side plate 1 and the right side plate 2 at lower portions thereof, and a chain guide 47 for guiding the load chain 61 is provided between the left side plate 1 and the right side plate 2 at upper portions of the load sheave 3. Provided above the chain guide 47 is an upper hook 48 for suspending the chain block.

Figure 6:
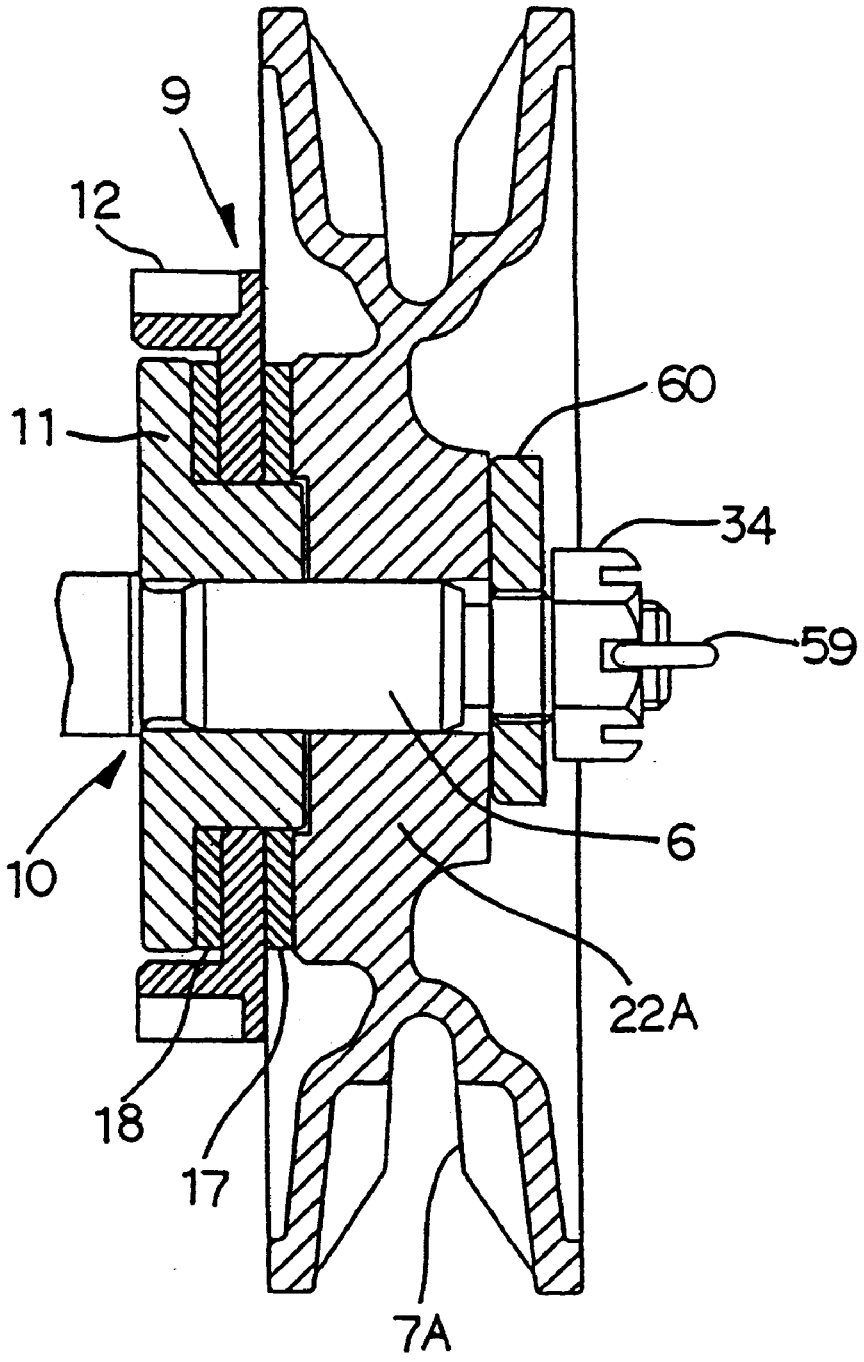
FIG. 6 illustrates in longitudinal section a principal part of one embodied form of a chain block which is not equipped with an overload protection mechanism.

According to the illustrated chain block thus structured, the set nut 34 can be fixed in the first recess 32 opening at the small-diameter cylindrical portion 31 of the first hub 13 to share the use of substantially the same drive shaft 6 as the one used in a chain block having the same specification as the illustrated chain block but the overload protection mechanism 8, such as, for example, the chain block whose principal part is shown in FIG. 6. This can permit the component sharing between the chain block with the overload protection mechanism 8 and the chain block having the same specification but having no overload protection mechanism, for simplifying the manufacturing operation or process and reducing costs. Especially, even a small-sized chain block whose drive shaft 6 is intended to have a reduced length for size reduction of the entire chain block can share the use of the drive shaft 6 substantially the same as that of the chain block having the same specification but having no overload protection mechanism 8, so that the effect is particularly significant.

It is noted that the chain block shown in FIG. 6 has the same specification as the chain block of the embodied form of the invention, except the provision of the overload protection mechanism, and the same members are indicated by the same reference numerals in FIG. 6. Though not shown in FIG. 6, one end portion of the drive shaft 6 is extended through the shaft hole of the load sheave 3, and the second hub 11 of the transmission mechanism 10 having the mechanical brake 9 is coupled with the drive shaft 6 in such a manner as to be non-rotatable relative thereto. Immediately at the axial outside of the second hub 11, the boss 22A of the hand wheel 7A is threadedly engaged with the drive shaft, instead of the first hub 13 of the overload protection mechanism 8. Also, the set nut 34 is threadedly engaged with the axial end portion of the drive shaft 6, with spaced at a predetermined interval from the boss 22A of the hand wheel 7A threadedly engaged with the drive shaft 6. The set nut 34 is fixed to the end portion of the drive shaft 6 by the set pin 59 so that it cannot be moved in the axial direction. The axial movement of the hand wheel 7A is restricted by the set nut 34, with a check washer 60 splined to the drive shaft 6 between the set nut 34 and the boss 22A of the hand wheel 7A.

According to the chain block of this embodied form of the invention, the first lining plate 23 and the second lining plate 24 of the overload protection mechanism 8 are received in the second recess 56 and the third recess 57 formed in the boss 22 of the hand wheel 7, respectively, so that the overload protection mechanism 8 can be reduced in size in the axial direction thereof by an amount corresponding to the thickness of the first and second lining plates 23, 24. Thus, combination of the arrangement of the set nut 34 being fixed in the first recess 32 opening at the small-diameter cylindrical portion 31 of the first hub 13 with the arrangement of the first and second lining plates 23, 24 being received in the second and third recesses 56, 57 can produce the advantageous effect that even a small-sized chain block having a considerably shortened drive shaft 6 can share the use of the drive shaft 6 substantially the same as that of the chain block having the same specification but having no overload protection mechanism 8.

For provision of the overload protection mechanism 8 combined with the hand wheel 7, it is necessary that the hand wheel 7 be rotatably supported on the first hub 13. Accordingly, the hand wheel separate from the hand wheel 7A of the chain block with no overload protection mechanism 8 must be prepared. The specific arrangement that the first recess 32, the second recess 56 and the third recess 57 are formed in only the part of the first hub 13 and the hand wheel 7 enables the sharing of the drive shaft 6 substantially the same as that of the chain block having the same specification but having no overload protection mechanism 8. Thus, the component sharing of the chain block, e.g. a small-sized one mentioned above, is intended by the manufacturing of minimum component counts and thereby significant simplification of the manufacturing operation or process of such a small-sized chain block and cost reduction are intended.

Further, since the first lining plate 23 and the second lining plate 24 are received in the second recess 56 and the third recess 57 formed in the boss 22 of the hand wheel 7, the first lining plate 23 and the second lining plate 24 are prevented from being out of position with respect to the boss 22 of the hand wheel 7. Therefore, a reliable braking of the hand wheel 7 can be achieved by the first and second lining plates 23, 24 to provide improved reliability of the overload protection mechanism 8.

According to the chain block of embodied form of the invention, in particular, since the first lining plate 23 and the second lining plate 24 placed at the opposite sides of the hand wheel 7 are received in the second recess 56 and the third recess 57 formed in the boss 22 of the hand wheel 7 at the both sides thereof, respectively, the overload protection mechanism 8 can be reduced in size in the axial direction thereof by an amount corresponding to the thickness of the first and second lining plates 23, 24. This can produce the result that even a small-sized chain block having a shortened drive shaft 6 can share the use of the drive shaft 6 substantially the same as that of the chain block having the same specification but having no overload protection mechanism 8. Also, since the hand wheel 7 can reliably be braked by both of the first lining plate 23 and the second lining plate 24, improved reliability of the overload protection mechanism 8 is yielded.

Next, the usage of the thus-constructed chain block thus constructed of the embodied form of the invention will be described.

First, description will be given on the hoist of or the lowering of a load which is less than a rated load preset by the load setting mechanism 21. The load is suspended from a lower hook (not shown) provided at the end of the load chain 61. When the hand chain 62 is operated to rotate the hand wheel 7 in the hoisting direction for the hoist of the load, the first hub 13 of the overload protection mechanism 8 which is in the state of rotatable with the hand wheel 7 is screwed forward along the drive shaft 6 to press the third lining plate 17 of the transmission mechanism 10, and thereby the drive shaft 6 is driven in the normal rotation direction through the second hub 11 of the transmission mechanism 10 coupled with the drive shaft 6 in such a manner as to be non-rotatable relative thereto. When the drive shaft 6 is driven, the drive is transmitted to the load sheave 3 through the reduction gear mechanism 36 and thereby the load sheave 3 is rotated in the direction for the load to be hoisted up. As a result of this, the load suspended from the lower hook provided at the end of the load chain 61 running over the load sheave 3 is hoisted up. The suspended load is kept in its hoisted position by the operation of the mechanical brake 9 or by the engagement of the anti-reverse pawl 15 with the anti-reverse gear 12.

When the hand chain 62 is operated to rotate the hand wheel 7 in the lowering direction for the lowering of the load, the first hub 13 of the overload protection mechanism 8 which is in the state of rotatable with the hand wheel 7 is screwed backward along the drive shaft 6. Then, the engagement between the flange portion 19 of the first hub 13 and the third lining plate 17 of the transmission mechanism 10 is disengaged to release the mechanical brake 9, and as such can allow the drive shaft 6 to freely rotate. As a result of this, the drive shaft 6 is rotated in the reverse rotation direction under the weight of load, so that the load is lowered down. On the other hand, the reverse rotation of the drive shaft 6 causes the first hub 13 of the overload protection mechanism 8 threadedly engaged with the drive shaft 6 to be screwed forward again along the drive shaft 6, to press the third lining plate 17 of the transmission mechanism 10. As a result of this, the mechanical brake 9 acts again to prevent the rotation of the drive shaft 6 in the reverse rotation direction. Thus, when the load is lowered down, the mechanical brake 9 is made active and inactive alternately so that the load sheave 3 can be allowed to rotate in the lowering direction little by little. The suspended load is lowered down in this manner.

When a load more than a rated load as preset by the load setting mechanism 21 is tried to be hoisted by the operation of the hand chain 62 to rotate the hand wheel 7 in the hoisting direction, slippage of the hand wheel 7 between the first lining plate 23 and the second lining plate 24 is caused by the action of the overload protection mechanism 8 to permit free rotation of the hand wheel 7 with respect to the first hub 13. Thus, the hoist of any load more than the rated load of the chain block is prevented.

On the other hand, for example when the overload protection mechanism 8 is put into action in the hoist of a load more than the rated load, the hand wheel 7 is held slipped between the first lining plate 23 and the second lining plate 24, and as such cannot permit the lowering of the load. In this situation, the hand wheel 7 can be restricted by the one-way mechanism 25 freely rotating in the lowering direction with respect to the first hub 13 to permit the lowering of even the load more than the rated load.

Figure 7:
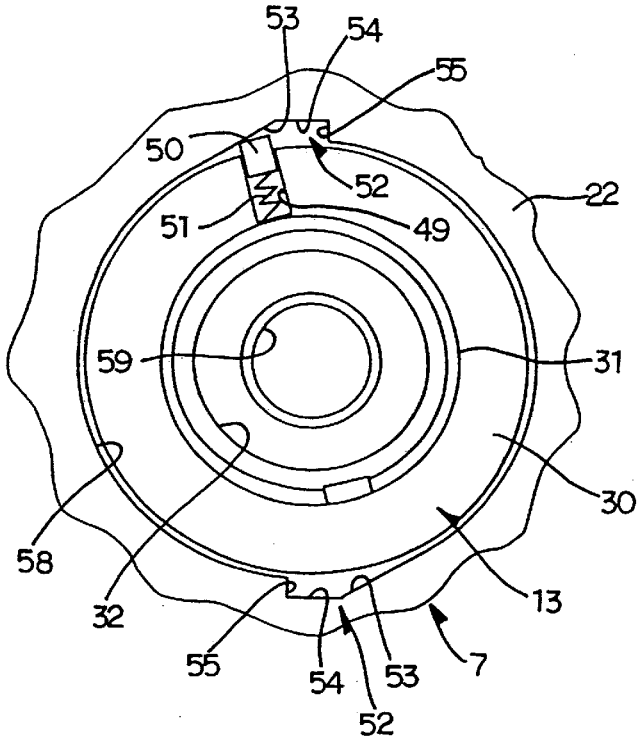
FIG. 7 illustrates in side elevation a principal part of an one-way mechanism.
Figure 8:
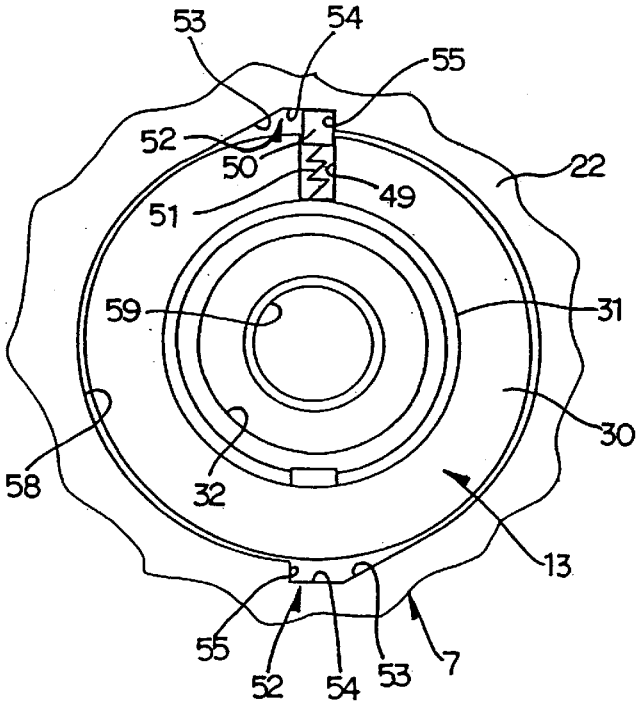
FIG. 8 illustrates in side elevation a principal part of the one-way mechanism.

Referring now to FIGS. 7 and 8, there are shown sectional views of a principal part of the one-way mechanism 25 for illustration thereof. In the following, the description on the one-way mechanism 25 will be given with reference to FIGS. 2, 7 and 8.

In FIG. 2, the one-way mechanism 25 is composed of a recess 49 formed in the outer periphery of the large-diameter cylindrical portion 30 of the first hub 13, a pin 50 of an engaging member provided in the recess 49, a spring 51 of an biasing means for biasing the pin 50 radially outwardly, and concave receiving portions 52 opening in the inner periphery of the receiving hole 58 in the boss 22 of the hand wheel 7 to receive the pin 50 therein.

The recess 49 is formed in rectangle in side configuration, opening from the outer periphery of the large-diameter cylindrical portion 30 into the radial inside of the same. The spring 51 is inserted in the recess 49 and the column-like pin 50 is disposed at a free end of the spring 51, such that the pin 50 is biased radially outwardly of the large-diameter cylindrical portion 30 by the biasing force of the spring 51.

On the other hand, two receiving portions 52 are formed in the inner periphery of the boss 22 of the hand wheel 7 at positions that are opposed to each other or shifted from each other at 180°.

The receiving portions 52 are each composed, as shown in FIGS. 7, 8, of a slanted surface 53, extended obliquely, for guiding the pin 50 received in the receiving portion 52 to the inner periphery of the boss 22 when the hand wheel 7 is rotated in the hoisting direction; a retaining surface 55, extended substantially along the radial direction of the inner periphery of the boss 22, for permitting the pin 50 received in the receiving portion 52 to be retained in the inside of the receiving portion 52 when the hand wheel 7 is rotated in the lowering direction; and a flat surface 54, extending continuously to the slanted surface 53 and the retaining surface 55, for holding the pin 50 received in the receiving portion 52.

Each slanted surface 53 is extended along a tangential direction to the inner periphery of the boss 22 of the hand wheel 7 and also is smoothed out at the boundary between the inner periphery of the boss 22 of the hand wheel 7 and the slanted surface 53. The slanted surfaces 53 of the receiving portions 52 that are located in opposition to each other are formed to be parallel with each other.

According to the one-way mechanism 25 thus constructed, when the hand wheel 7 is rotated in the hoisting direction for the hoist of a load more than a rated load, the hand wheel 7 is freely rotated with respect to the first hub 13. During this, every time the pin 50 of the one-way mechanism 25 faces the receiving portions 52 formed in the inner periphery of the boss 22 of the hand wheel 7, the pin 50 which is normally biased radially outwardly or toward the inner periphery of the boss 22 of the hand wheel 7 is received in the receiving portions 52, while on the other hand, the as-received pin 50 is smoothly guided again to the inner periphery of the boss 22 of the hand wheel 7 along the slanted surface 53 formed in each of the receiving portions 52 (this state is shown in FIG. 7). Since the pin 50 is smoothly guided again to the inner periphery of the boss 22 of the hand wheel 7 through the slanted surfaces 53 which are each extended along a tangential direction to the inner periphery of the boss 22 of the hand wheel 7 and smoothed out at the boundary between the inner periphery of the boss 22 of the hand wheel 7 and the slanted surface 53, the pin 50 received in the receiving portions 52 can be guided smoothly to the inner periphery of the boss 22 of the hand wheel 7 just the way it is, without causing the pin 50 received in the receiving portions 52 to rattle.

As a result of this, a possible problem that the pin 50 may be caught in the receiving portion 52 so that a load more than a rated load may be hoisted in an unstable state or a possible damage of the pin 50 and the receiving portion 52 can be minimized. Also, the rattling of the hand wheel 7 that may be caused when rotated can be minimized and a possible damage to the first hub 13 and the hand wheel 7 can be minimized.

On the other hand, for example, even when the overload protection mechanism 8 is put into action in the hoist of a load by the application of load more than a rated load, such that the hand wheel 7 is held slipped between the first lining plate 23 and the second lining plate 24, the hand wheel 7 can be restricted freely rotating in the lowering direction with respect to the first hub 13 by the pin 50 of the one-way mechanism 25 being received in the receiving portion 52. This can permit the lowering of even a load more than the rated load. At that time, the pin 50 received in the receiving portion 52 is well retained by the retaining surfaces 55 formed in the receiving portion 52 (this state is shown in FIG. 8). Thus, the free rotation of the hand wheel 7 with respect to the first hub 13 can be reliably restricted and thereby the lowering of even a load more than a rated load can be ensured.

When the hand wheel 7 is in the state in which it freely rotates in the hoisting direction with respect to the first hub 13, every time the hand wheel 7 rotates one turn, the pin 50 is received in the receiving portions 52 provided at the opposed positions. Since the receiving portions 52 have the slanted surfaces 53 which are so formed as to be substantially parallel with each other, the pin 50, even when received in any of the receiving portions 52, is guided into the inner periphery of the boss 22 of the hand wheel 7 along the slanted surfaces 53 under the same condition. For example, in the hand operated chain block of the embodied form of the invention in which even a little pulling of the hand chain 62 causes the hand wheel 7 to rotate a couple of turns with respect to the first hub 13, so as to give several opportunities of the pin 50 to confront the receiving portions 52, since the receiving portions 52 are provided at the opposed positions and also the slanted surfaces 53 are so formed as to be substantially parallel with each other, even when the pin 50 is given many opportunities to confront the receiving portions 52, the pin 50 is received cliclically in the receiving portions 52 as the hand wheel 7 rotates and is guided to the inner periphery of the boss 22 of the hand wheel 7 along the slanted surface 53 under the same condition. Thus, regular operations can be ensured, and as such can produce improved durability and reliability of the one-way mechanism 25.

On the other hand, when the hand wheel 7 is rotated in the lowering direction, the pin 50 is received in either of the receiving portions 52 provided in the opposed positions during one-turn of the hand wheel 7. Thus, the pin 50 is surely brought into engagement in the receiving potions 52 until the hand wheel 7 rotates one turn, thus enabling the immediate lowering of load.

Thus, even in a hand operated chain block, like the chain block of the embodied form of the invention, in which even a little pulling of the hand chain 62 in the hoisting direction causes the hand wheel 7 to rotate with respect to the first hub 13 a couple of turns during which the pin 50 confronts the receiving portions 52 several times, when the hand wheel 7 is rotated in the hoisting direction, smooth free rotation of the hand wheel 7 with respect to the first hub 13 can be ensured, while also, when the hand wheel 7 is rotated in the lowering direction, the pin 50 can smoothly be received in the receiving portions 52 to ensure the smooth lowering of load.

Especially, in a small-sized chain block having the hand wheel 7 having a small diameter, like that of the embodied form of the invention, in which even a little pulling of the hand chain 62 causes the pin 50 to confront the receiving portions 52 several times, good operation of the pin 50 and the receiving portions 52 can be ensured by the inventive arrangement above and, thus, further improved durability and reliability of the one-way mechanism 25 can be provided.

While the two receiving portions 52 in the one-way mechanism 25 of the embodied form of the invention are formed in the inner periphery of the receiving hole 58 of the boss 22 of the hand wheel 7 at the opposed positions, the receiving portions may alternatively be formed at different positions from the opposed positions. Further, one or three or more receiving portions may alternatively be formed. It should be noted, however, that too many receiving portions 52 would cause an increased rattling of the hand wheel 7 with respect to the first hub 13, while on the other hand, only one receiving portion 52 could not provide the immediate lowering of load as mentioned above. In view of this, it is most preferable for the small-sized chain block like that of embodied form of the invention that two receiving portions be formed at opposed positions, in terms of improvement in operability, durability and reliability of the chain block.

While in the embodied form of the invention the second recess 56 and the third recess 57 are formed in the boss 22 of the hand wheel 7 at the both sides thereof, the recess may alternatively be formed in the boss at either side thereof. Further, instead of the pin 50, a ball may be used in the one-way mechanism 25.

While the illustrative embodiments of the present invention is provided in the above description, such is for illustrative purpose only and it is not to be construed restrictively. Modification and variation of the present invention that will be obvious to those skilled in the art is to be covered in the following claims.

What is claimed is:

1. A chain block comprising:

a load sheave with which a load chain is engageable;

a hand wheel with which a hand chain is engageable;

a transmission mechanism including a mechanical brake interposed between said hand wheel and said load sheave;

an overload protection mechanism that supports said hand wheel and permits said hand wheel to freely rotate in a hoisting direction when a load more than a rated load is applied to said load sheave; and a drive shaft, passed through said load sheave, said transmission mechanism and said overload protection mechanism, to transmit drive applied from said hand wheel to said load sheave, wherein said overload protection mechanism includes a hub member threadedly engaged with said drive shaft and supporting thereon said hand wheel in a freely rotatable manner; and a one-way mechanism that permits said hand wheel to freely rotate in a hoisting direction with respect to said hub member and restricts said hand wheel freely rotating in a lowering direction;

wherein said one-way mechanism includes a recess formed in an outer periphery of said hub member; an engaging member provided in said recess and normally biased radially outwardly; and a concave receiving portion, opening in an inner periphery of a boss of said hand wheel, to receive said engaging member therein;

wherein said receiving portion includes a slanted surface extended obliquely to guide said engaging member received in said receiving portion to said inner periphery of said boss of said hand wheel when said hand wheel is rotated in said hoisting direction; and a retaining surface, extended substantially along a radial direction of said inner periphery of said boss, to permit said engaging member received in said receiving portion to be retained in an inside of said receiving portion when said hand wheel is rotated in a lowering direction; and wherein said slanted surface formed in said receiving portion is extended along a tangential direction to said inner periphery of said hand wheel and also is smoothed out at a boundary between said inner periphery of said boss of said hand wheel and said slanted surface.

2. A chain block according to claim 1, wherein there are provided two receiving portions which are opened in said inner periphery of said hand wheel at positions opposed to each other and of which slanted surfaces are formed to be substantially parallel to each other.

* * * * *